US005809672A

United States Patent [19]

Jones

[11] Patent Number: 5,809,672

[45] Date of Patent: Sep. 22, 1998

[54] MANUALLY ACTUATED LATERALLY POSITIONABLE WING PLOW YOKE

[75] Inventor: Daniel K. Jones, Madison, Wis.

[73] Assignee: Burke Truck & Equipment, Madison, Wis.

[21] Appl. No.: 845,719

[22] Filed: Apr. 25, 1997

Related U.S. Application Data

[60] Provisional application No. 60/016,198 Apr. 25, 1996.

[51] Int. Cl. [6] ..... E01H 5/06; E01H 5/04

[52] U.S. Cl. ..... 37/274; 37/231; 172/272

[58] Field of Search ..... 37/231, 236, 272, 37/273, 276, 283; 172/815, 451, 272, 273, 274, 275; 414/722, 723, 724

[56] References Cited

U.S. PATENT DOCUMENTS

| | | | |
|---|---|---|---|
| 1,784,284 | 12/1930 | Guy et al. | 37/417 |
| 1,976,597 | 10/1934 | Bird | 172/815 |
| 2,449,269 | 9/1948 | Austin | 37/428 X |
| 2,704,017 | 3/1955 | Wilson | 172/383 |
| 3,232,358 | 2/1966 | Heiberg | 172/742 |
| 4,790,085 | 12/1988 | Rossman | 37/231 |
| 4,802,293 | 2/1989 | Smith | 37/273 X |
| 4,863,338 | 9/1989 | Johnson | 414/724 X |
| 4,962,598 | 10/1990 | Woolhiser et al. | 37/231 |
| 5,411,102 | 5/1995 | Nickels et al. | 37/231 X |

*Primary Examiner*—Tamara L. Graysay
*Assistant Examiner*—Thomas A. Beach
*Attorney, Agent, or Firm*—DeWitt Ross & Stevens SC

[57] ABSTRACT

A wing plow yoke which may be manually actuated to laterally move outwardly from the front side of a plowing vehicle to allow access to the vehicle's hood, and thus to its engine. Mounting brackets attached to opposite sides of the front of the vehicle are provided with bracket apertures wherein a yoke bar is fit so that the yoke bar can move within the bracket apertures. A gear wheel or a fulcrum-and-lever arrangement is provided which engages a series of spaced depressions situated along the length of the yoke bar. By turning the gear wheel, or by selectively engaging depressions in the yoke bar with the lever, the yoke bar (and thus the wing plow) is moved laterally outwardly from the side of the vehicle. This arrangement avoids the need for any power transmission from the engine in order to move the yoke bar, and thus the yoke bar (and wing plow) may be moved outwardly from the side of the vehicle even in the event of engine failure. Advantageously, exposure to road debris, ice, and other elements increases the friction between the yoke bar and the mounting brackets so that the yoke bar is resistant to unwanted motion within the mounting brackets.

20 Claims, 1 Drawing Sheet

MANUALLY ACTUATED LATERALLY POSITIONABLE WING PLOW YOKE

CROSS-REFERENCE TO RELATED APPLICATIONS

This application claims priority under 35 USC §119(e) to U.S. Provisional Pat. application No. 60/016,198 filed 25 Apr. 1996, the entirety of which is incorporated by reference herein.

FIELD OF THE INVENTION

The invention relates generally to snow plow improvements, and more particularly to improvements for wing plows.

BACKGROUND OF THE INVENTION

In common snow plow vehicles, e.g., snow plows, a forward plow scoop is mounted to the front of the vehicle and one or more wing plow scoops are pivotally mounted to the front sides of the vehicle at approximately the front corners of the vehicle. These wing plow scoops may be actuated by hydraulic cylinders to swing out from the vehicle, thereby increasing the effective plowing width of the vehicle. While this arrangement works very well for clearing snow, the wing plows unfortunately tend to hinder access to the hood of the vehicle, and therefore to the engine: the forward plow scoop blocks access to the engine from the front, and the wing plows block it from the sides. Even where only one wing plow is present along one side of the engine, thereby allowing access to the engine from the other side of the vehicle, the side of the engine adjacent the wing plow is effectively inaccessible.

The inventor of the present invention discovered a means for alleviating this problem. As illustrated in FIG. 1, a laterally adjustable snow plow yoke includes a wing plow 12 (only partially shown in FIG. 1) which is mounted to a yoke bar 14 held within yoke mounting brackets 16 descending from a front plow yoke 18. The front plow yoke 18, whereupon a front plow scoop (not shown) is attached, is anchored to the frame of the vehicle. (Neither the front plow scoop nor the vehicle are shown in FIG. 1). The yoke bar 14 of the front plow yoke 18 is slidably mounted to the yoke mounting brackets 16 so that the yoke bar 14 can be laterally slid to one side of the vehicle, thereby moving the wing plow 12 outward from the side of the vehicle. The mounting brackets 16 include bracket apertures 20 through which the yoke bar 14 may slide. To better support the heavy yoke bar 14, a sleeve 22 extends between adjacent mounting brackets 16 so that the yoke bar 14 is supported therein. To move the heavy yoke bar 14 and wing plow 12, a hydraulic cylinder 23 is placed between one mounting bracket 16 and the yoke bar 14 so that actuation of the cylinder 23 drives the yoke bar 14 and wing plow 12 inwardly and outwardly.

Unfortunately, certain problems were found with this arrangement. First, where the power for the hydraulic cylinder 23 is provided by the vehicle's engine, the snowplow operator may not be able to actuate the hydraulic cylinder 23 if engine problems arise. Ironically, the wing plow 12 can then be frozen in a position which blocks access to the engine, thereby making the laterally positionable wing plow 12 a hindrance in precisely the situation it was to help. Second, the hydraulic cylinder 23 is subject to sticking, corrosion and abrasion wear, and impact damage owing to salt, grit, and other debris flying off the road, and also due to the extreme temperatures at which the cylinder 23 must operate. The hoses associated with the hydraulic system are particularly susceptible to damage. This increases the maintenance costs of the apparatus to an extent where it is more economically feasible to simply use an immobile wing plow yoke and simply take the chance that engine access may be blocked in the event of engine failure.

SUMMARY OF THE INVENTION

The present invention, which is defined by the claims set out at the end of this disclosure, is directed to a wing plow yoke which may be manually actuated to laterally move outward from the front side of the vehicle to allow access to the vehicle's hood, and thus to its engine. The mounting brackets for the forward plow are provided with bracket apertures wherein a yoke bar is fit so that the yoke bar can move in an axial direction within the bracket apertures. An actuating means for manually actuating such motion is then provided. Such an actuating means preferably takes the form of either a gear wheel or a fulcrum-and-lever arrangement which engages a series of spaced depressions situated along the length of the yoke bar. By turning the gear wheel, or by selectively engaging depressions in the yoke bar with the lever, the yoke bar (and thus the wing plow) is moved laterally outwardly from the side of the vehicle. This arrangement avoids the need for any power transmission from the engine in order to move the yoke bar, and thus the yoke bar (and wing plow) may be moved outwardly from the side of the vehicle even in the event of engine failure. These arrangements have been found to be highly resistant to fouling and jamming owing to ice and road debris collection, and require little or no maintenance to remain operational. Friction is avoided to the greatest possible extent so that the wing plow is easily moved outwardly from the side of the vehicle without the use of expensive hydraulics or similar maintenance-intensive power-transmitting equipment.

DETAILED DESCRIPTION OF THE INVENTION

Figure 2:
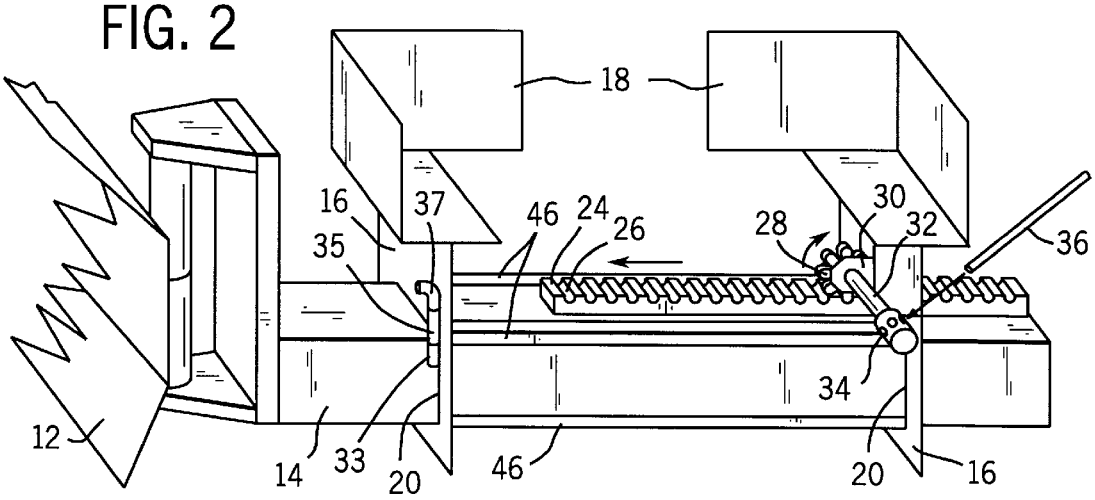
FIG. 2 is a perspective view of a first embodiment of the present invention, a manually-driven laterally positionable wing plow yoke.

In the drawings, wherein the same or similar features of the invention are designated in all Figures with the same reference numerals, a first preferred embodiment of the invention is shown at FIG. 2, wherein a crank-powered laterally positionable wing plow yoke 18 is illustrated. A series of teeth 24 (and thus a series of depressions 26 between the teeth 24) is provided along the length of the yoke bar 14, and a gear wheel 28 is rotatably mounted to a clevis 30 on one mounting bracket 16 so that the gear wheel 28 engages the depressions 26. (If desired, the teeth 24 could be eliminated and the depressions 26 could be cut directly into the yoke bar 14. However, the embodiment illustrated in FIG. 2 can advantageously be constructed using off-the shelf components without any need for precisely spacing and cutting depressions 26.) The gear wheel 28 is further attached to an axle 32 which extends away from the vehicle. The axle 32 has one or more holes 34 at one end wherein an elongated beam 36 or crowbar may be inserted to form a crank. When the beam 36 is inserted within a hole 34 and pulled upward or downward, the gear wheel 28 is rotated so that the yoke bar 14 is moved laterally inward or outward, thereby moving the wing plow 12 toward or away from the vehicle. When the beam 36 cannot rotate any further owing to an obstruction, the beam 36 may be removed from the hole 34 and inserted into another hole 34 at the end of the axle 32 so that cranking may be continued. The beam 36 could be replaced with a variety of other levering means for turning the axle 32, such as a T-shaped beam, crank, or wheel which axially engages the axle 32, but the elongated beam 36 is preferred owing to the high degree of leverage it provides. A removable beam 36 rather than a permanent crank or other permanent levering means is preferred because a permanent levering means could inadvertently be actuated if impacted by a stream of snow or a chunk of ice. If desired, the yoke bar 14 may include a sleeve 33 and one mounting bracket 16 may similarly include a sleeve 35. The sleeves 33 and 35 are aligned when the yoke bar 14 (and wing plow 12) are in the desired plowing position, thereby allowing insertion of a pin 37 within the sleeves 33 and 35 to lock the yoke bar 14 in place.

Figure 3:
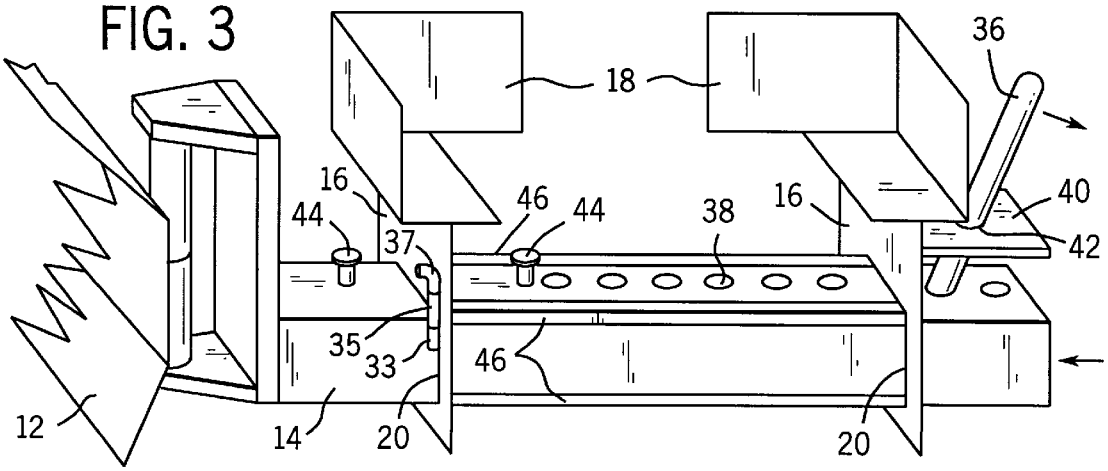
FIG. 3 is a perspective view of a second embodiment of the manually-driven laterally positionable wing plow yoke.

A second preferred embodiment is the lever-actuated laterally positionable wing plow yoke 12 of FIG. 3. The yoke bar 14 bears a series of depressions or holes 38 along its length, and one mounting bracket 16 has a structure 40 extending therefrom in a direction generally parallel to the yoke bar 14. An eye 42 is included in this structure 40 so that the end of a beam 36 (e.g., a crowbar) can be inserted within the eye 42 and then within a depression 38 in the yoke bar 14. The structure 40 can then act as a fulcrum and the beam 36 can act as a lever, and the beam 36 can be pushed or pulled in either direction generally parallel to the yoke bar 14 in order to push the yoke bar 14 in a lateral direction. If desired, after the yoke bar 14 has been precisely positioned in the desired location, a pin may be inserted within both the eye 42 and one depression 38 in the yoke bar 14 to insure that the yoke bar 14 will not slide laterally after it is set in the desired position. The use of a removable beam 36 is recommended because a beam fixed permanently in position runs the risk of inadvertent shifting of the yoke bar 14 and wing plow 12 if the beam is struck by chunks of ice or a stream of thrown snow.

As illustrated in FIG. 3, the yoke bar 14 may include one or more limits 44 which abut the mounting brackets 16 at the most extreme lateral positions desired, so that the yoke bar 14 cannot inadvertently be run out of the bracket apertures 20. However, the limits 44 preferably take the form of removable bolts, pins, or the like so the limits 44 can be removed when removal of the yoke bar 14 is desired.

Figure 1:
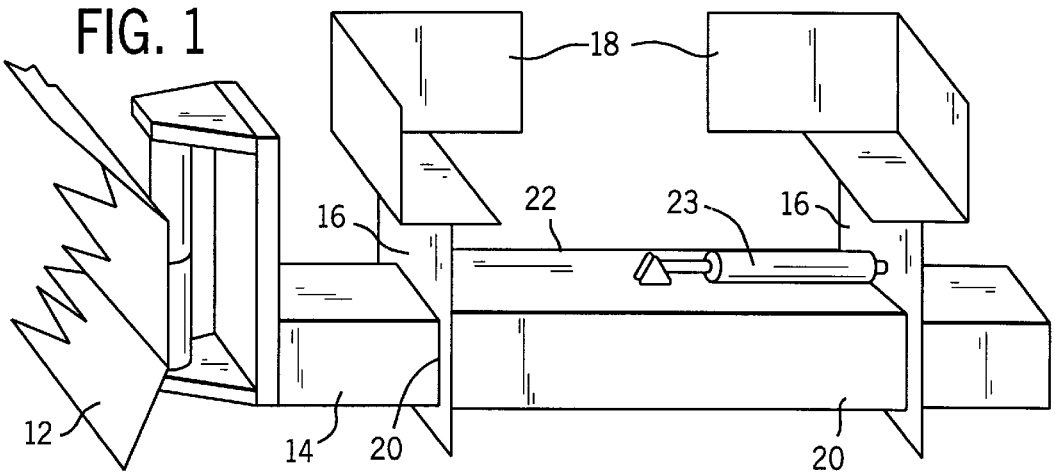
FIG. 1 is a perspective view of a prior embodiment of a laterally positionable wing plow yoke.

In the embodiments of FIGS. 1 and 2, the sliding friction of the yoke bar 14 is reduced by utilizing channels 46 to support the yoke bar 14, rather than a sleeve 22. Because the surface area of the structure supporting the yoke bar 14 is decreased, this arrangement provides less friction when manually moving the yoke bar 14 by use of the actuating means. It is also possible to reduce friction by reinforcing the mounting brackets 16 to such an extent that no channels 46, sleeves 22, or other supporting structures for the yoke bar 14 are necessary.

The aforementioned embodiments are believed to offer the best potential for remaining in operational condition despite prolonged wear and collection of debris and ice. However, other embodiments are possible as well; in particular, other actuating means for manually moving the yoke bar 14 in a lateral direction can be used in place of those shown in FIGS. 2–3. For example, the gear wheel 28 illustrated in FIG. 2 can be replaced by a worm gear or other gear system which may be cranked to act on the teeth 24 and drive the yoke bar 14 inward and outward. This worm gear could, for example, be attached to the mounting bracket(s) 16 in an orientation parallel to the yoke bar 14, and it could include a removable crank. Alternatively, such a worm gear could fit within threaded apertures provided in pillow blocks attached to the yoke bar 14 so that rotation of the worm gear drives the pillow blocks (and thus the yoke bar 14) inward and outward. The lever arrangement of the embodiment of FIG. 3 could be replaced by a ratcheting arrangement much like that on a common tire jack; however, it is believed that this embodiment would be highly susceptible to jamming owing to ice and debris. If desired, the actuating means could be duplicated on two or more mounting brackets 16, but since only one of the actuating means (the one furthest away from the wing plow 12) will be easily accessible, this is not necessary.

Preferred embodiments of the invention have been described above in order to illustrate how to make and use the invention. The invention is not intended to be limited to these embodiments, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A wing plow positioning apparatus comprising:

a. spaced mounting brackets adapted for attachment to a vehicle, each bracket defining a bracket aperture therein;

b. an elongated yoke bar extending within the bracket apertures, the yoke bar including a first end, an opposing second end, and a row of regularly spaced depressions situated therebetween;

c. an actuating means situated on one mounting bracket for manually actuating lengthwise movement of the yoke bar within the bracket apertures by sequentially engaging one or more depressions within the row and exerting force along the direction of the length of the yoke bar.

2. The wing plow positioning apparatus of claim 1 including at least one channel extending between the mounting brackets and adjacent the yoke bar.

3. The wing plow positioning apparatus of claim 1 wherein the actuating means comprises a gear wheel bearing teeth thereon, the teeth extending within the depressions in the yoke bar.

4. The wing plow positioning apparatus of claim 3 wherein the gear wheel includes an axle extending therefrom and a beam extending from the axle.

5. The wing plow positioning apparatus of claim 4 wherein the beam is detachable from the axle.

6. The wing plow positioning apparatus of claim 1 wherein the actuating means comprises a fulcrum and a beam extending from the fulcrum, the beam being selectively engageable within the depressions.

7. The wing plow positioning apparatus of claim 6 wherein the beam is removable from the fulcrum.

8. The wing plow positioning apparatus of claim 7 wherein the fulcrum comprises a structure protruding from the mounting bracket, the structure having an eye defined therein wherein the removable beam is fit.

9. A wing plow positioning apparatus comprising:

a. at least two mounting brackets, each mounting bracket including a bracket aperture therein;

b. a yoke bar situated within the bracket apertures, the yoke bar including a series of depressions extending lengthwise along the yoke bar;

c. an actuating means attached to one bracket for pushing the yoke bar in a lengthwise direction, the actuating means extending within at least one depression and engaging the yoke bar.

10. The wing plow positioning apparatus of claim 9 further comprising at least one channel extending between the mounting brackets and adjacent the yoke bar.

11. The wing plow positioning apparatus of claim 9 wherein the actuating means includes a fulcrum having a beam extending therefrom, the beam including one end engageable with the depressions.

12. The wing plow positioning apparatus of claim 9 wherein the actuating means includes a gear wheel having teeth extending within the depressions.

13. The wing plow positioning apparatus of claim 12 wherein the gear wheel includes an axle extending therefrom, and an elongated beam extending from the axle, wherein manual actuation of the beam causes rotation of the gear wheel.

14. The wing plow positioning apparatus of claim 13 wherein the beam is removable from the axle.

15. A wing plow positioning apparatus comprising:

a. spaced mounting brackets adapted for attachment to a vehicle, each bracket including a bracket aperture therein;

b. an elongated yoke bar extending within the bracket apertures, the yoke bar including a first end and an opposing second end, the second end bearing a wing plow;

c. an actuating means on one bracket for manually actuating lengthwise movement of the yoke bar within the bracket apertures, the actuating means including a removable beam insertable within the actuating means.

16. The wing plow positioning apparatus of claim 15 including at least one channel extending between the mounting brackets and adjacent the yoke bar.

17. The wing plow positioning apparatus of claim 15 wherein the actuating means defines a fulcrum wherein the removable beam is fit, the removable beam extending between the fulcrum and the yoke bar.

18. The wing plow positioning apparatus of claim 17 wherein the fulcrum comprises a structure protruding from the mounting bracket and having a space defined therein wherein the removable beam is fit.

19. The wing plow positioning apparatus of claim 15 wherein the actuating means comprises a gear wheel having teeth thereon, and further wherein the yoke bar includes a series of depressions engageable by the teeth.

20. The wing plow positioning apparatus of claim 19 wherein the gear wheel includes an axle extending therefrom, the axle being engageable by the removable beam, thereby allowing manual actuation of the beam to rotate the gear wheel.

* * * * *